US011226101B2

(12) United States Patent
Sampath et al.

(10) Patent No.: US 11,226,101 B2
(45) Date of Patent: Jan. 18, 2022

(54) COMBUSTOR SWIRLER

(71) Applicant: General Electric Company, Schenectady, NY (US)

(72) Inventors: Karthikeyan Sampath, Bangalore (IN); Saket Singh, Bangalore (IN); Gurunath Gandikota, Bangalore (IN); Perumallu Vukanti, Bangalore (IN); Pradeep Naik, Bangalore (IN); Steven Clayton Vise, Loveland, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 150 days.

(21) Appl. No.: 16/264,775

(22) Filed: Feb. 1, 2019

(65) Prior Publication Data

US 2020/0248903 A1 Aug. 6, 2020

(51) Int. Cl.
*F23R 3/14* (2006.01)
*F23R 3/28* (2006.01)

(52) U.S. Cl.
CPC ..... *F23R 3/14* (2013.01); *F23R 3/286* (2013.01)

(58) Field of Classification Search
CPC ..... F23R 3/14; F23R 3/286
See application file for complete search history.

(56) References Cited

U.S. PATENT DOCUMENTS 5,417,070 A * 5/1995 Richardson ..... F23C 7/004 239/406
6,453,671 B1 12/2002 Leen et al.
6,834,505 B2 12/2004 Al-Roub et al.
7,013,649 B2 3/2006 Monty
7,104,066 B2 9/2006 Leen et al.
7,131,273 B2 11/2006 Howell et al.
2011/0271682 A1* 11/2011 Sandelis ..... F23R 3/14 60/737
2014/0090382 A1* 4/2014 Sandelis ..... F23R 3/28 60/740

FOREIGN PATENT DOCUMENTS

CN 204372988 U 6/2015

* cited by examiner

*Primary Examiner* — Katheryn A Malatek
(74) *Attorney, Agent, or Firm* — Venable LLP; Elizabeth C. G. Gitlin; Michele V. Frank

(57) ABSTRACT

A gas turbine engine swirler that includes a tubular body having a forward face, an aft end, and a throat. A plurality of primary swirl vanes that is positioned between the aft end and the forward face. A plurality of secondary swirl vanes that is positioned between the primary swirl vanes and the aft end. The plurality of primary swirl vanes and the plurality of secondary swirl vanes are configured such that the throat is fluidly connected to a plenum that is positioned outside of the tubular body. A tubular ferrule is positioned such that it joins the body at the forward face thereof. Each of the primary swirl vanes extend radially inwardly to a vane lip. The secondary swirl vanes extend radially inwardly for swirling air therefrom. The body also includes a tubular Venturi that extends aft from between the primary swirler vanes and the secondary swirler vanes for radially separating air swirled therefrom. Wherein the primary swirl vanes are configured to swirl air along a passageway and through an outlet that is oriented axially aft.

20 Claims, 6 Drawing Sheets

COMBUSTOR SWIRLER

BACKGROUND OF THE INVENTION

The present invention relates generally to gas turbine engines, and more specifically, to combustors therein.

In a gas turbine engine, air is pressurized in a compressor and mixed with fuel in a combustor for generating hot combustion gases that flow downstream through turbine stages which extract energy therefrom. A high pressure turbine powers the compressor, and a low pressure turbine produces useful work by powering an upstream fan in a typical turbofan gas turbine engine aircraft engine application, for example.

Combustor performance is critical to the overall performance of the gas turbine engine. The compressed air is mixed with fuel in the combustor for generating a fuel and air mixture which is ignited for generating the combustion gases.

For a typical annular combustor, a row of carburetors in the form of discrete swirlers and cooperating fuel injectors are used to mix the fuel and air prior to combustion, with the combustion gases being circulated downstream through the combustor for discharge to the turbines.

In a second known design, a row of primary radial swirl vanes replace the primary jets and operate in conjunction with the secondary radial swirl vanes, i.e., rad-rad design, for typically swirling the air in counter rotation around the injected fuel.

The rad-rad design is considered superior in performance because it eliminates the cause of auto-ignition by eliminating zones of separated airflow caused by the discrete primary jets in the jet-rad design. However, the rad-rad design requires a large amount of purge air from the fuel injectors to produce axial momentum in the fuel and air mixture for establishing the desirable recirculation zone within the combustor dome.

Since the recirculation zone in the combustor is a key contributor to overall combustor performance, the particular design of the swirler affects combustor performance Fine tuning the shape of the recirculation bubble can significantly enhance the performance of a swirler w.r.t to mixing, smoke and dynamics etc.

BRIEF DESCRIPTION OF THE INVENTION

The technology disclosed herein helps to achieve intended shape and position of the recirculation bubble inside the venturi. The new design helps to achieve control over mixing, achieve reduced smoke and reduced coking without destabilizing the CRZ Accordingly, there is provided herein a gas turbine engine swirler that includes a tubular body having a forward face, an aft end, and a throat. A plurality of primary swirl vanes are positioned between the aft end and the forward face. A plurality of secondary swirl vanes are positioned between the primary swirl vanes and the aft end. The plurality of primary swirl vanes and the plurality of secondary swirl vanes are configured such that the throat is fluidly connected to a plenum that is positioned outside of the tubular body. A tubular ferrule is positioned such that it joins the body at the forward face thereof. Each of the primary swirl vanes extend radially inwardly to a vane lip. The secondary swirl vanes extend radially inwardly for swirling air therefrom. The body also includes a tubular Venturi that extends aft from between the primary swirl vanes and the secondary swirl vanes for radially separating air swirled therefrom. Wherein the primary swirl vanes are configured to swirl air along a passageway and through an outlet that is oriented axially aft such that the air has aft momentum.

Accordingly, there is provided a gas turbine engine that includes a swirler. The swirler includes a tubular body having a forward face, an aft end, and a venturi throat positioned between the forward face and the aft end. A plurality of secondary swirl vanes is positioned between the forward face and the aft end such that the plurality of secondary swirl vanes extend radially inwardly for swirling air therefrom. A tubular ferrule joins the body at the forward face. A plurality of primary swirl vanes is positioned between the forward face and the secondary swirl vanes wherein each vane curves axially. The primary vanes have a common annular primary inlet that faces radially outwardly for swirling air radially inwardly. The body also includes a tubular venturi that extends aft from between said primary and secondary vanes for radially separating air swirled therefrom. The primary swirl vanes are configured to swirl air along a passageway that is radially oriented and that curves to define a primary swirl vane outlet that is oriented axially aft.

Accordingly, there is provided a method for operating a gas turbine engine that includes a swirler. The swirler includes a tubular body having a forward face, an aft end, and a venturi throat positioned between the forward face and the aft end. A plurality of secondary swirl vanes is positioned between the forward face and the aft end such that the plurality of secondary swirl vanes extend radially inwardly for swirling air therefrom. A tubular ferrule joins the body at the forward face. A plurality of primary swirl vanes is positioned between the forward face and the secondary swirl vanes wherein each vane curves axially. The primary vanes have a common annular primary inlet that faces radially outwardly for swirling air radially inwardly. The body also includes a tubular venturi that extends aft from between said primary and secondary vanes for radially separating air swirled therefrom. The primary swirl vanes are configured to swirl air along a passageway that is radially oriented and that curves to define a primary swirl vane outlet that is oriented axially aft. The method includes the step of discharging air from the primary swirlers such that the air has axially aft.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
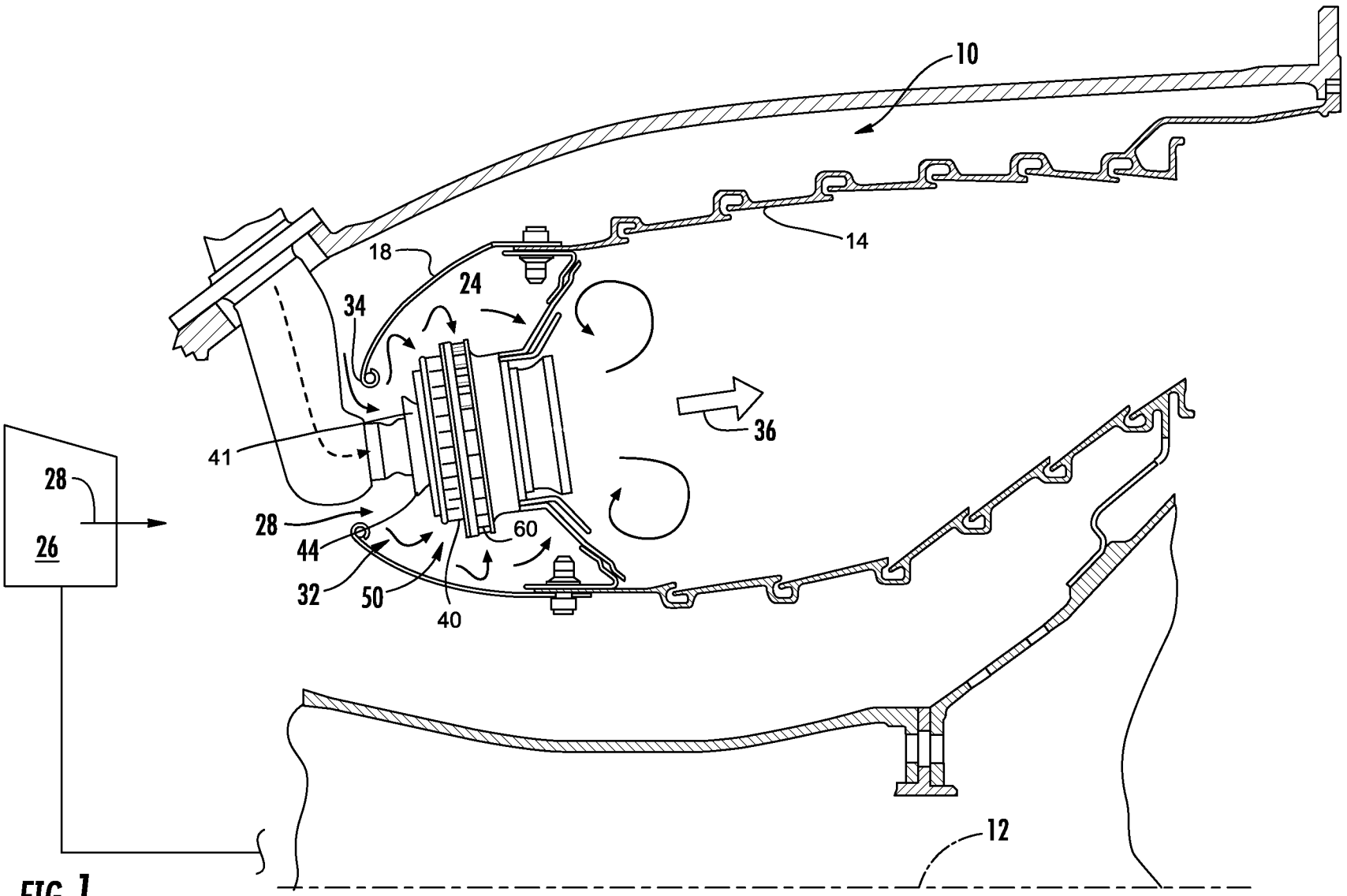
FIG. 1 is an axial, partly sectional view of a portion of an exemplary annular combustor of a turbofan gas turbine engine including a swirler in accordance with the disclosed technology.

Referring to the drawings wherein identical reference numerals denote the same elements throughout the various views, the disclosed technology Illustrated in FIG. 1 is a portion of an exemplary turbofan gas turbine engine including an annular combustor that includes a swirler as will be described in detail below. The invention will be described according to multiple embodiments.

Figure 2:
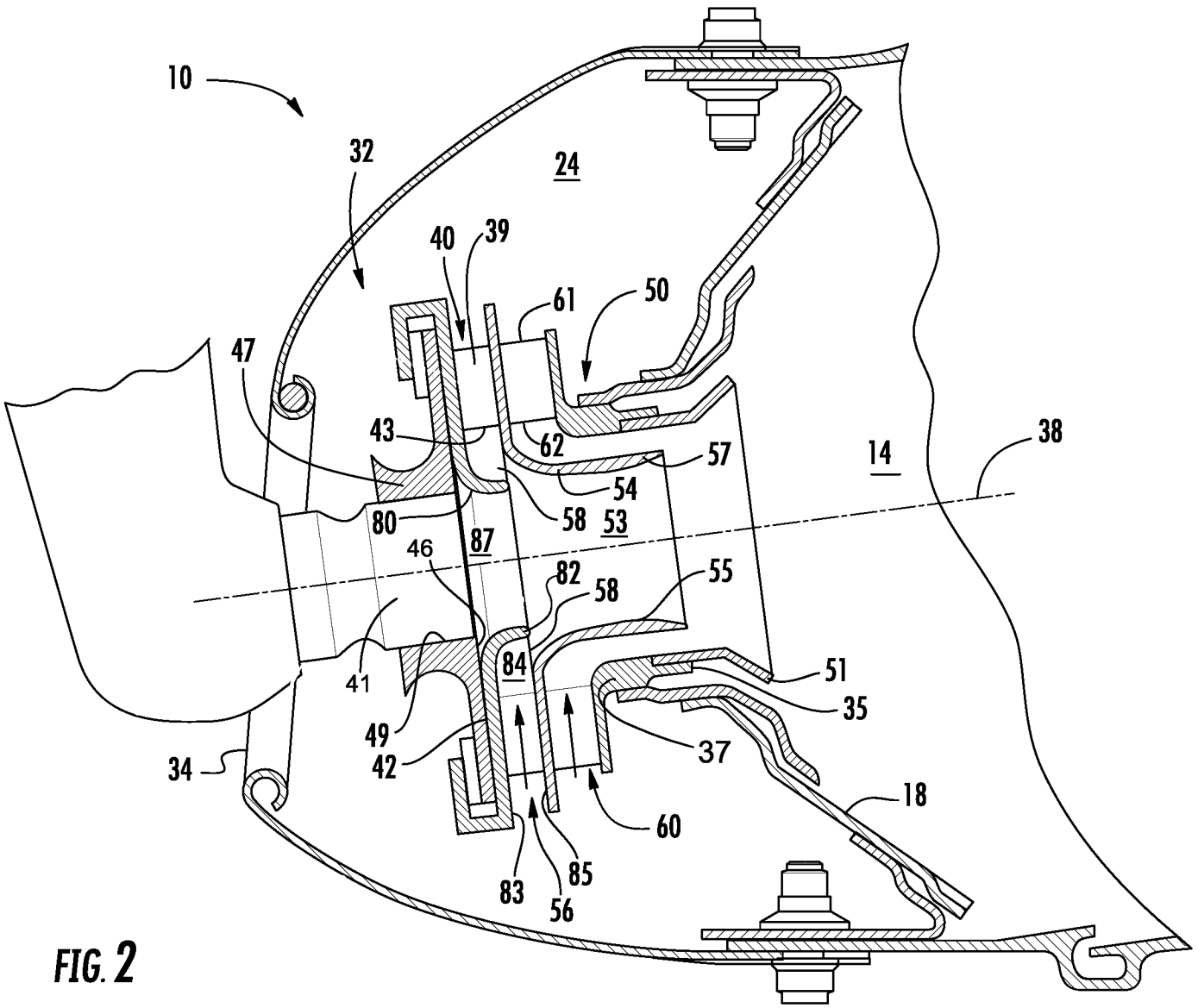
FIG. 2 is an enlarged, axial sectional view through the swirler illustrated in FIG. 1.

Referring now to FIGS. 1 and 2, the annular combustor 10 is suitably mounted inside a casing coaxially about a longitudinal or axial centerline axis 12. The combustor 10 includes radially outer and inner annular combustor liner 14 which is suitably joined at upstream ends thereof to an annular combustor dome 18.

The exemplary combustor is a singular annular combustor design and includes radially outer and inner cowls extending axially forwardly from the dome 18 at the juncture with the outer and inner liners to define an annular plenum 24 on the upstream side of the dome 18.

As shown in FIG. 1, the engine includes a suitable compressor 26, such as a conventional multistage axial compressor, suitably configured for pressurizing and airstream 28 as the airstream 28 flows downstream therethrough.

The pressurized airstream 28 is channeled axially downstream from the compressor 26 through a suitable diffuser and is introduced into the plenum 24 through a first annular inlet 34. The combustor 10 as described above and the compressor 26 may have any conventional configuration.

In accordance with the present invention, the combustor 10 illustrated in FIG. 1 includes a plurality of swirlers 50 suitably mounted in the combustor dome 18. The swirler 53 (FIG. 2) with a corresponding fuel injection nozzle 41 to define a carburetor 32. Each nozzle 41 injects fuel into the swirler 50 wherein it is mixed within a throat 53 with pressurized airstream air 28 for generating a fuel and air mixture which is suitably ignited for generating hot combustion gases that collectively flow downstream through a channel defined by the combustor liner 14.

The combustion gases 36 (FIG. 1) are discharged from the outlet end of the combustor into a high pressure turbine (not shown) which extracts energy therefrom for powering the compressor 26.

A low pressure turbine (not shown) is disposed downstream of the high pressure turbine and is suitably configured for producing output power, such as for powering an upstream fan in a typical turbofan gas turbine engine aircraft application.

Figure 4:
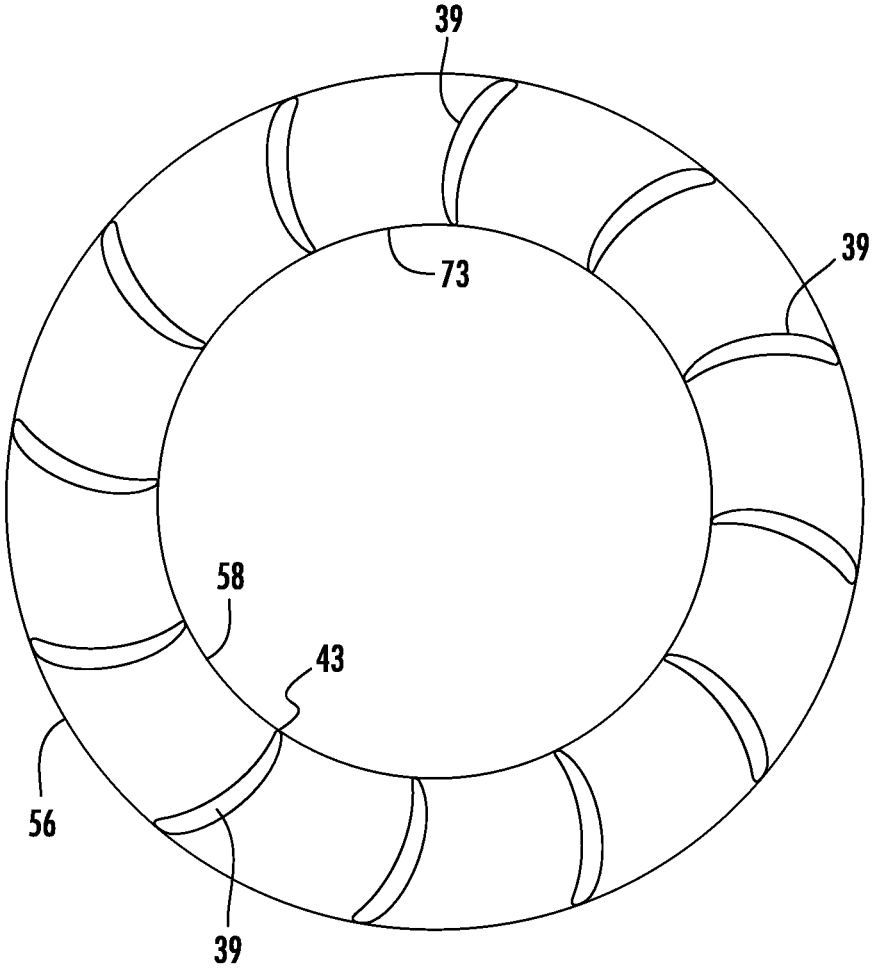
FIG. 4 shows a stylized plan view of a portion of the swirler shown in FIG. 3 showing a plurality of vanes.
Figure 6:
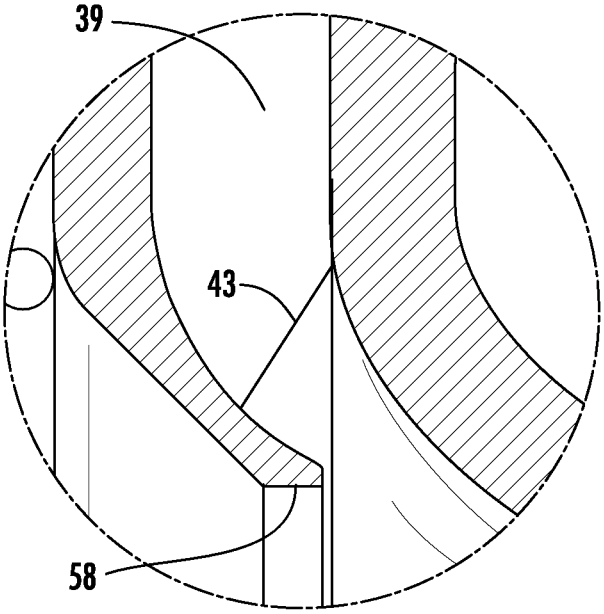
FIG. 6 shows a portion of cutaway view of the swirl are shown in FIG. 3 as indicated by a circle 6.

An exemplary one of the swirlers 50 is illustrated in more detail in FIG. 2, and is axisymmetrical about its own axial centerline axis 38. Each swirler 50 includes a tubular body 37 having an aft end 35 suitably fixedly joined to the combustor dome 18, and an axially forward face 42 at the opposite end thereof. The body 37 further includes a primary swirler 40 and a secondary swirler 60. The primary swirler 40 includes a plurality of swirl vanes 39. The swirl vanes 39 are circumferentially disposed in a row that such that each of the vanes 39 extends radially inwardly to a vane lip 43. Thus the primary swirl of 40 is configured for swirling a corresponding portion of the pressurized airstream 28 (see FIG. 1) radially inwardly from the plurality of swirl vanes 39 of swirler 40. As can be seen in FIG. 6, vanes 39 can be curved such that vane lip 43 approaches outlet 58 of the primary swirler 40. According to the embodiment illustrated in FIG. 2, vanes 39 can be substantially flat such that the vane lip 43 is spaced further away from the outlet 58. Alternatively, the vane lip can be positioned closer to the outlet 58 when the vanes 39 are configured with more curve. Vanes 39 are circumferentially disposed as shown in FIG. 4.

The body 37 typically also includes a tubular venturi 54 extending aft from its juncture with the upstream side of the secondary vanes 60, with a venturi outlet 57 near the outlet of the body 37 itself. The body 37 typically also includes an annular baffle 51 extending from its aft end 35 and into the combustor dome 18 for providing a barrier for the combustion gas flamefront.

The tubular body 37 including the secondary vanes 60 and venturi 54 may have any conventional configuration and is typically formed as a unitary casting. The secondary vanes 60 are inclined radially or circumferentially inwardly relative to the centerline axis 38 of the swirler 50 for imparting swirl to the air channeled therebetween.

Figure 3:
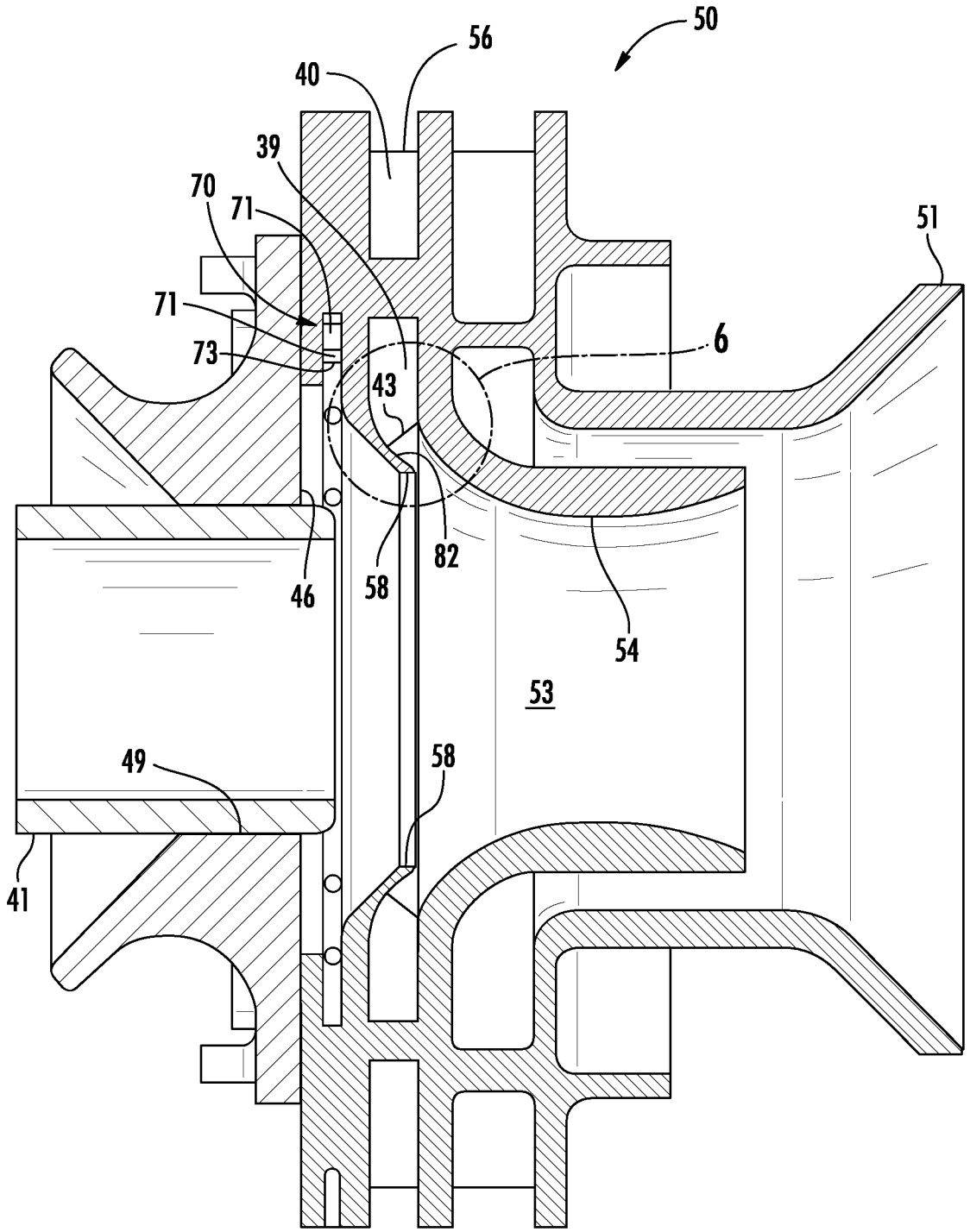
FIG. 3 shows a cutaway side view of the swirler shown in FIG. 2.

Each swirler 50 also includes a tubular ferrule 47 having a central bore 49 (as shown in FIG. 3) in which the fuel injection nozzle 41 is loosely disposed. A flat aft face 46 of the ferrule 47 extends radially in a slip fit adjoining the flat forward face 42 of the body 37 and is suitably retained thereto by an annular retainer in a conventional manner. In this way, the ferrule 47 may slide radially inwardly and outwardly relative to the centerline axis of the engine under the effects of differential thermal expansion and contraction between the fuel injector nozzle supported by the casing and the combustor 10 which supports the swirlers 50.

The primary vanes 40 illustrated in FIGS. 2 and 3 have a common annular inlet 56 defined by the outer perimeter of the ferrule 47 between corresponding first and second side plates 83 and 85, i.e. walls, between which the individual primary vanes 40 are mounted, preferably in a common or unitary casting.

As indicated above, the primary swirl vanes 40 also include a common annular primary outlet 58 facing aft. At least a portion of the primary outlet 58 is disposed axially aft or downstream of inlet 56. The primary outlet 58 is defined by an aft curved wall 80 that extends that extends to a lip 82 from a primary swirler wall 83 that defines a portion of a channel 84. In this way, the primary vanes 40 are effective as radial swirl vanes for swirling the pressurized airstream 28 radially inwardly into the tubular body 37, yet with the addition of a suitable component of axial momentum in the aft direction not found in conventional radial vanes.

The secondary swirl vanes 60 similarly have a common annular inlet 61 around the perimeter thereof, and a common annular secondary outlet 62 radially inwardly thereof. The inlet 61 faces in full radially outwardly, with the secondary outlet 62 facing in full radially inwardly, and with the secondary vanes 60 being disposed preferably only radially inwardly, without axial inclination, for functioning as radial swirl vanes.

As indicated above, the tubular venturi 54 may have a conventional design but extends in a new cooperation from between the junction of the primary and secondary swirl vanes 40 and 60 at the forward face 42 of the tubular body 37 and downstream through the tubular body 37 for radially separating the air swirled from the primary and secondary vanes 50 and 60. An inner flow surface 55 of the venturi 54 converges to a throat of minimum flow area and then diverges to the outlet end thereof in a conventional manner for discharging the fuel and air mixture from the swirler with a suitable cone angle without flow separation from the inner surface of the venturi or the downstream baffle 51.

Figure 5:
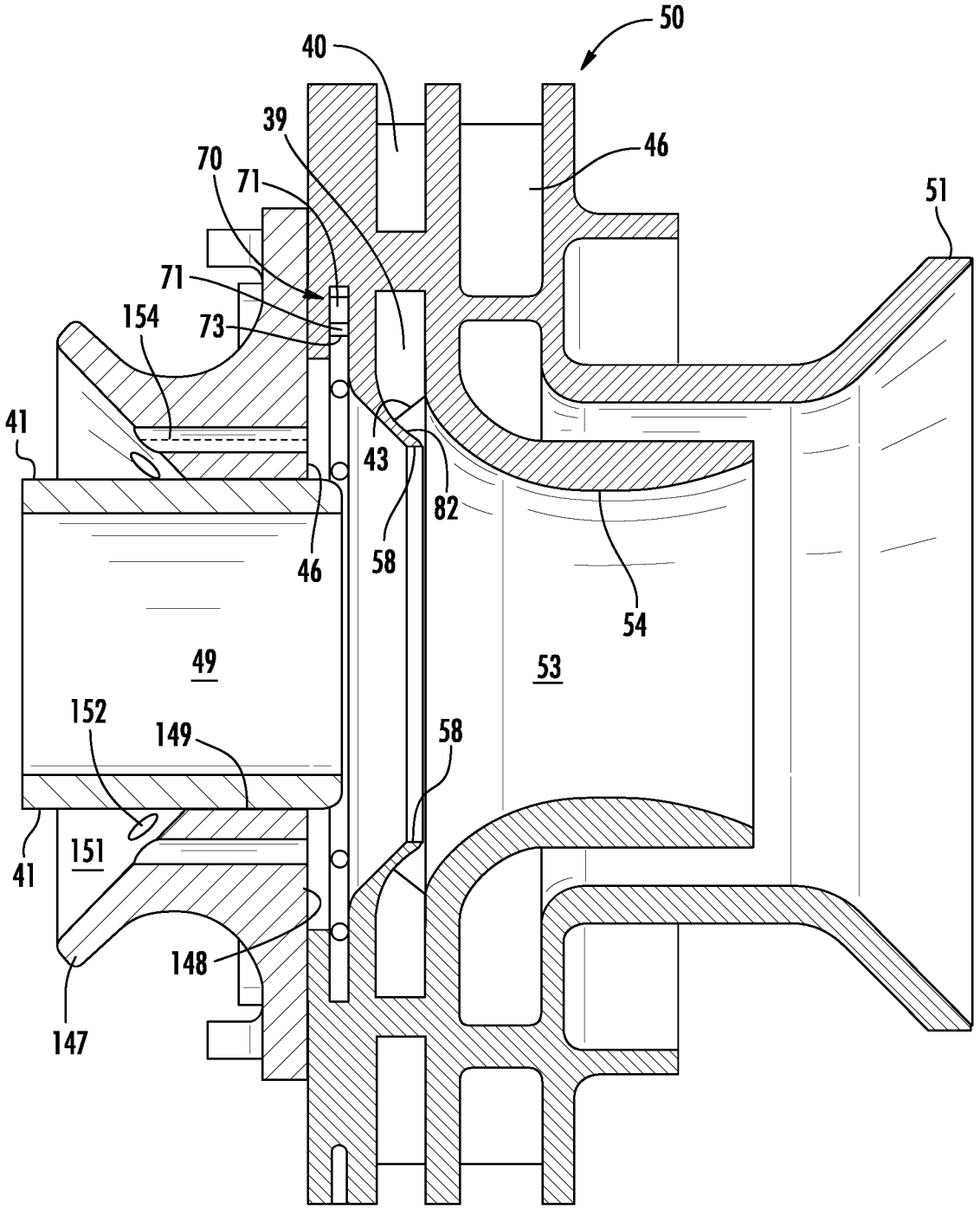
FIG. 5 shows a cutaway side view of the swirler shown in FIG. 2 according to another embodiment.
Figure 7:
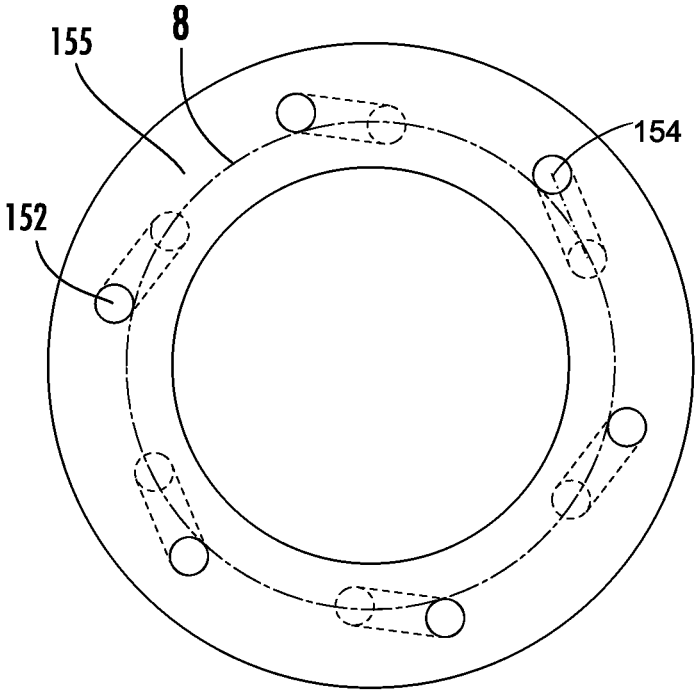
FIG. 7 shows an overhead view of a ferrule 47 showing placement of channels through the federal.
Figure 8:
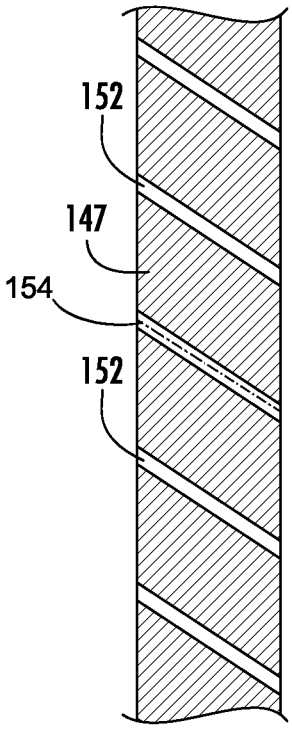
FIG. 8 shows a portion of an unwrapped sectional view of the federal shown in FIG. 7 taken along circle 8.

As can be seen in FIG. 5, the ferrule 47 of the swirlers 50 can be replaced by ferrule 147 configured to provide additional airflow to further impact improved swirling. In this regard, the ferrule 147 defines an outer surface 151 and a plurality of channels 152 that extend from a first end defined at the outer surface 151 to a second end defined at an inner surface 148 of the ferrule 147. In this manner, the ferrule 147 is configured such that the plenum 24 (FIG. 1) is fluidly connected to the throat 53 and via the channels 152. The channels 152 are disposed such that they define a circle 155 (FIG. 7) having a center point on axis 38. The channels 152 each have an axis 154. The channels 152 can be oriented such that the axes 154 are parallel to the axis 38 as shown in FIG. 5. Optionally the channels 152 can be disposed such that the axes 154 are angled radially such that the first and second ends are different distances from the axis 38. The axes 154 can also be angled relative to the respective tangents of the circle 155. As shown in FIGS. 7 and 8, the channels 152 can be positioned such that the axes 154 are angled both radially and tangentially.

Referring now to FIG. 3, each of the swirlers 50 can include an additional co-swirler i.e., a tertiary swirler 70. The tertiary swirlers 70 are configured to reduce autoignition risk in a region 87 that is positioned forward of primary outlet 58. In this regard, the tertiary swirlers 70 are configured to prevent formation of a dead zone within the region 87 during operation of combustor 10. The tertiary swirlers 70 are positioned forward of the primary swirler 40 and just aft of the forward face 42 of the body 37. The tertiary swirlers 70 includes a plurality of vanes 71. The tertiary swirlers 70 include a channel (not shown) configured such that tertiary swirlers 70 are fluidly connected to inlet 56 of the primary swirler 40. In this manner, a portion of air 28 can be introduced into the tertiary swirlers 70 such that it passes through the vanes 71 and is discharged via an outlet 73.

The presently disclosed technology can be better understood from a description of the operation thereof. During operation of the combustor 10, air 28 is pressurized by compressor 26. 28 then flows through annular inlet 34 to enter plenum 24. Air 28 then passes through at least one of the primary swirler 40 and the secondary swirler 60. Additionally, air 28 can pass through the tertiary swirler 70 and the channels 152 in configurations in which the swirler 50 includes a ferrule 147. In this manner, air 28 enters throat 53 of the swirler 50.

As air 28 enters throat 53, fuel is introduced into throat 53 via the nozzle 41. As the fuel is introduced into the swirling air 28 it mixes with air 28 to provide a combustible mixture of combustion gases 36. The combustible mixture of combustion gases 36 defines a stagnation point within the tubular venturi. In some embodiments the stagnation point is positioned such that it is aft of the venturi outlet 57.

Additionally, a portion of air 28 passes through the tertiary swirler 70 thus preventing a dead zone from forming in the region 87.

The foregoing has described an apparatus, i.e., a combustor that includes a swirler configured to reduce the dynamics amplitude of flow through the swirler to very low amplitudes compared to conventional swirlers. One advantage is reducing the tendency for fuel coking within the venturi region.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not limited to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A gas turbine engine swirler comprising:

a tubular body having a forward face, an aft end, and a throat;

a plurality of primary swirl vanes positioned between the aft end and the forward face, each of the plurality of primary swirl vanes comprising a primary outlet, wherein the primary outlet is defined by a curved wall extending to a wall lip from a primary swirler wall, the primary swirler wall being forward of the plurality of primary swirl vanes;

a plurality of secondary swirl vanes positioned between the primary swirl vanes and the aft end;

the plurality of primary swirl vanes and the plurality of secondary swirl vanes are configured such that the throat is fluidly connected to a plenum that is positioned outside of the tubular body;

a tubular ferrule adjoining said tubular body at said forward face thereof and defining the plurality of primary swirl vanes;

each of the primary swirl vanes extend radially inwardly to a vane lip;

the secondary swirl vanes extend radially inwardly for swirling air therefrom;

said tubular body further including a tubular venturi extending aft from between the primary swirl vanes and the secondary swirl vanes for radially separating the air swirled therefrom; and wherein the primary swirl vanes are configured to swirl the air radially inwardly along a passageway into the tubular body and through the primary outlet that is oriented axially aft such that the air has an axial aft momentum component.

2. The gas turbine engine swirler of claim 1, wherein each of the plurality of primary swirl vanes curves axially.

3. The gas turbine engine swirler of claim 2, wherein the vane lip is spaced-away from the primary outlet.

4. The gas turbine engine swirler of claim 3, comprising a tertiary swirler that is positioned forward of the the plurality of primary swirl vanes and aft of the forward face of the tubular body and configured to prevent formation of a dead zone within the tubular body.

5. The gas turbine engine swirler of claim 2, wherein each of the plurality of primary swirl vanes ends at the primary outlet.

6. The gas turbine engine swirler of claim 5, comprising a tertiary swirler that is positioned forward of the the plurality of primary swirl vanes.

7. The gas turbine engine swirler of claim 1, wherein the tubular ferrule has a forward surface that is fluidly connected to the plenum and an aft surface that is fluidly connected to the throat and a plurality of channels are defined through the tubular ferrule from a first end at the forward surface to a second end at the aft surface such that the plenum is fluidly connected to the throat through the plurality of channels.

8. The gas turbine engine swirler of claim 7 wherein the tubular ferrule has a first axis and the plurality of channels each have a second axis and each of the second axes are substantially parallel to the first axis.

9. The gas turbine engine swirler of claim 7 wherein the tubular ferrule has a first axis and the plurality of channels each have a second axis and each of the second axes are not parallel to the first axis.

10. A gas turbine engine swirler comprising:

a tubular body having a forward face and an aft end;

a tubular ferrule adjoining said tubular body at said forward face thereof and defining a plurality of primary swirl vanes;

the plurality of primary swirl vanes positioned between the forward face and the aft end, wherein each of the plurality of primary swirl vane curves axially, each of the plurality of primary swirl vanes comprising a primary outlet, wherein the primary outlet is defined by a curved wall extending to a wall lip from a primary swirler wall, the primary swirler wall being forward of the plurality of primary swirl vanes;

a plurality of secondary swirl vanes positioned between the plurality of primary swirl vanes and the aft end such that the plurality of secondary swirl vanes extend radially inwardly for swirling air therefrom;

said plurality of primary swirl vanes having a common annular primary inlet facing radially outwardly for swirling the air radially inwardly;

said tubular body further including a tubular venturi extending aft from between said plurality of primary swirl vanes and said plurality of secondary swirl vanes for radially separating the air swirled therefrom; and wherein the primary swirl vanes are configured to swirl the air radially inwardly along a passageway into the tubular body and through the primary outlet that is oriented axially aft such that the air has an axial aft momentum component.

11. The gas turbine engine swirler of claim 10, wherein the primary swirl vanes end between the common annular primary inlet at a position that is spaced away from the primary outlet.

12. The gas turbine engine swirler of claim 11, comprising a tertiary swirler that is positioned between the forward face and the plurality of primary swirl vanes and configured to prevent formation of a dead zone within the tubular body.

13. The gas turbine engine swirler of claim 12, wherein the tubular ferrule has a forward surface that is fluidly connected to a plenum and an aft surface that is fluidly connected to a throat and a plurality of channels are defined through the tubular ferrule from a first end at the forward surface to a second end at the aft surface such that the plenum is fluidly connected to the throat through the tubular ferrule.

14. The gas turbine engine swirler of claim 10, wherein the primary swirl vanes end at the primary outlet.

15. The gas turbine engine swirler of claim 14, comprising a tertiary swirler that is positioned between the primary swirl vanes and the forward face.

16. The gas turbine engine swirler of claim 15, wherein the tubular ferrule has a forward surface that is fluidly connected to a plenum and an aft surface that is fluidly connected to a throat and a plurality of channels are defined through the tubular ferrule from a first end at the forward surface to a second end at the aft surface such that the plenum is fluidly connected to the throat through the tubular ferrule.

17. The gas turbine engine swirler of claim 10, wherein the tubular ferrule has a forward surface that is fluidly connected to a plenum and an aft surface that is fluidly connected to a throat and a plurality of channels are defined through the tubular ferrule from a first end at the forward surface to a second end at the aft surface such that the plenum is fluidly connected to the throat through the tubular ferrule.

18. A method for operating a gas turbine engine that includes a swirler, the swirler comprising:

a tubular body having a forward face, an aft end, and a Venturi throat positioned between the forward face and the aft end;

a tubular ferrule adjoining said tubular body at said forward face thereof and defining a plurality of primary swirl vanes;

the plurality of primary swirl vanes positioned between the forward face and the aft end, each of the plurality of primary swirl vanes comprising a primary outlet, wherein the primary outlet is defined by a curved wall extending to a wall lip from a primary swirler wall, the primary swirler wall being forward of the plurality of primary swirl vanes, wherein each of the plurality of primary swirl vanes curves axially, a plurality of secondary swirl vanes positioned between the plurality of primary swirl vanes and the aft end such that the plurality of secondary swirl vanes extend radially inwardly for swirling air therefrom;

said plurality of primary swirl vanes having a common annular primary inlet facing radially outwardly for swirling the air radially inwardly, said tubular body further including a tubular venturi extending aft from between said plurality of primary swirl vanes and said plurality of secondary swirl vanes for radially separating the air swirled therefrom; and wherein the primary swirl vanes are configured to swirl the air radially inwardly along a passageway into the tubular body; the method comprising the step of:

discharging the air from the the plurality of primary swirl vanes through the primary outlet that is oriented axially aft such that the air has an axially aft momentum component.

19. The method of claim 18 further comprising the step of:

forming a stagnation point at a stable axial location which prevents the oscillations of the CRZ.

20. The method of claim 19 further comprising the step of:

forming a stagnation point at a stable axial location which prevents the oscillations of the CRZ.

* * * * *